US008847152B2

(12) United States Patent
Scigocki

(10) Patent No.: US 8,847,152 B2
(45) Date of Patent: Sep. 30, 2014

(54) MULTIPLEXED TANDEM MASS SPECTROMETRY METHOD

(75) Inventor: David Scigocki, Saint Vallier de Thiey (FR)

(73) Assignee: Physikron SA (FR)

( * ) Notice: Subject to any disclaimer, the term of this patent is extended or adjusted under 35 U.S.C. 154(b) by 88 days.

(21) Appl. No.: 13/512,739

(22) PCT Filed: Oct. 29, 2010

(86) PCT No.: PCT/EP2010/066508

§ 371 (c)(1),
(2), (4) Date: May 30, 2012

(87) PCT Pub. No.: WO2011/064068

PCT Pub. Date: Jun. 3, 2011

(65) Prior Publication Data

US 2012/0241603 A1 Sep. 27, 2012

Related U.S. Application Data

(60) Provisional application No. 61/265,029, filed on Nov. 30, 2009.

(51) Int. Cl.
*H01J 49/26* (2006.01)
*H01J 49/00* (2006.01)

(52) U.S. Cl.
CPC ..... *H01J 49/0036* (2013.01)
USPC ..... 250/282

(58) Field of Classification Search
USPC ..... 250/282
See application file for complete search history.

(56) References Cited

U.S. PATENT DOCUMENTS 4,472,631 A 9/1984 Enke et al.
5,206,508 A 4/1993 Alderdice et al.

(Continued)

FOREIGN PATENT DOCUMENTS

EP 1385194 A2 1/2004
WO 2004085992 A2 10/2004

(Continued)

OTHER PUBLICATIONS

Li et al., "Database searching and accounting of multiplexed precursor and product ion spectra from the data independent analysis of simple and complex peptide mixtures", Proteomics, vol. 9, No. 6, Mar. 10, 2009, pp. 1696-1719, XP002631430, Weinheim, Germany.

(Continued)

*Primary Examiner* — Nicole Ippolito
*Assistant Examiner* — Eliza Osenbaugh-Stewar
(74) *Attorney, Agent, or Firm* — Lerner, David, Littenberg, Krumholz & Mentlik, LLP

(57) ABSTRACT

The invention concerns a method for multiplexed tandem mass spectrometry of a sample to be analyzed containing at least two precursors, wherein at least two simplified multiplexed MS-MS spectra are obtained each from at least two selected precursors of the sample, the method comprising: (d) for each selected precursor generating an individual MS-MS spectrum from the simplified multiplexed MS-MS spectrum by selecting fragment ions of the simplified multiplexed MS-MS spectrum, the fragment ions are potential fragment ions obtained from the precursor; (e) submitting each individual MS-MS spectrum of step (d) to a real and a decoy database searches using a scoring process without score threshold condition or low score threshold condition for identifying candidate precursors and their fragment ions; (f) producing real individual MS-MS spectra from identified candidate precursors resulting from the real database search of step (e); and producing decoy individual MS-MS spectra from identified candidate precursors resulting from the decoy database search of step (e); (g) submitting the real and decoy individual MS-MS spectra to a further scoring process with a score threshold condition for determining a score for each real and decoy individual MS-MS spectra.

20 Claims, 4 Drawing Sheets

(56) References Cited

U.S. PATENT DOCUMENTS

| | | | | |
|---|---|---|---|---|
| 7,141,784 | B2 | 11/2006 | Vachet et al. | |
| 8,481,924 | B2 * | 7/2013 | Savitski et al. | 250/282 |
| 2005/0098721 | A1 | 5/2005 | Bateman et al. | |
| 2013/0187038 | A1 * | 7/2013 | Grothe, Jr. | 250/282 |

FOREIGN PATENT DOCUMENTS

| | | | |
|---|---|---|---|
| WO | 2006133191 | A2 | 12/2006 |
| WO | 2007077245 | A1 | 7/2007 |
| WO | 2008142170 | A1 | 11/2008 |
| WO | 2008151140 | A2 | 12/2008 |
| WO | 2009080833 | A2 | 7/2009 |

OTHER PUBLICATIONS

International Seach Report and Written Opinion for Application No. PCT/EP2010/066508 dated Apr. 15, 2011.

C. Masselon et al., "Identification of tryptic peptides from large databases using multiplexed tandem mass spectrometry: simulations and experimental results", proteomics, 3, (2003), p. 1279-1286.

J.D. Pinston et al., "New timeofflight mass spectrometer for improved mass resolution, versatility, and mass spectrometry/mass spectrometry studies",Review of Scientific Instruments, 57 (4), (1986), p. 583-592.

* cited by examiner

MULTIPLEXED TANDEM MASS SPECTROMETRY METHOD

CROSS REFERENCE TO RELATED APPLICATIONS

The present application is a national phase entry under 35 USC §371 of International Application No. PCT/EP2010/066508, filed Oct. 29, 2010, published in English, which claims priority from U.S. Patent Application No. 61/265,029 filed Nov. 30, 2009, all of which are incorporated herein by reference.

FIELD OF THE INVENTION

The invention relates to the general field of mass spectrometry.

STATE OF THE ART

By way of a reminder, mass spectrometry (MS), whatever its type, generally includes steps used to analyze the molecules present in a sample by measuring the mass of these molecules after they have been ionised in an ion source, accelerated and injected into a mass spectrometer.

A mass spectrometer generates a mass spectrum of the various molecules contained in the analysed sample, as a function of the mass-to-charge ratio (m/z) value of the generated ions.

In particular, tandem mass spectrometry (MS-MS) is well known as powerful tool for identifying and characterising molecules, and is generally used when the primary mass spectrum does not allow the identification of the generated ions.

Tandem mass spectrometers are generally composed of two mass spectrometers operating sequentially in space and separated by a dissociation device, or a single mass analyzer operating sequentially in time.

It generally includes steps required to generate, by means of the first mass spectrometer, a primary mass spectrum (MS) of the ionized molecules (called precursor ions) present in the sample to analyse, to perform a step for the selection of a precursor mass in the primary (MS) mass spectrum, for example via a mass selection window, and then to fragment, i.e. to dissociate by means of a dissociation device, the precursor ions of said selected precursor mass, so as to generate a mass spectrum described as the dissociation (MS-MS) mass spectrum of the fragments ions generated by the dissociation of the precursor ions, by means of the second mass spectrometer.

These steps are repeated for each selected precursor mass of the primary MS spectrum generating as many MS-MS spectra as selected precursor masses.

The precursor mass selection, generally implemented to generate each MS-MS spectrum, limits the acquisition debit of the tandem mass spectrometer, as the MS-MS spectra are generated one after the other.

It also significantly increases the amount of samples used to generate the MS-MS spectra compared with MS spectrum production, the remaining unselected precursor ions provided by the ion source being actually eliminated for the generation of the MS-MS spectrum of the selected primary ions.

Besides this first limitation in throughput due to the successive precursor mass selections, a second limitation is the possible selection of more than one precursor per mass selection window for producing each MS-MS spectrum.

This inadvertently multiplexed mass selection is due to the width of the mass selection window used to produce the MS-MS spectra which. The mass selection window is broader than the resolution of the mass spectrometer, especially for high resolution mass spectrometers. The width of the mass selection window is broader compared with MS resolution because of the MS ion selection devices used for the precursor mass selection in tandem mass spectrometers.

The fragment ions of the plurality of selected precursor ions increase the complexity of the produced MS-MS spectrum, and generally decrease the identification efficiency of the precursor that was aimed at by the precursor mass selection by the analysis of the MS-MS spectrum.

Simplified MS and MS-MS spectra are, thus, commonly produced from the peaks by different techniques such as deisotoping, de-charging, calibration, etc., in which the MS and MS-MS mass spectra are used for the final analysis leading to the identification of the precursors.

The simplified MS and MS-MS spectra are generally a list of mass-to-charge ratio m/z values and corresponding maximum intensity values corresponding to the peaks of the MS and MS-MS spectra. Ion charges are also used when they are determined.

The above limitations of standard tandem mass spectrometry are especially serious in protein analysis (proteomics) of complex mixtures of peptides obtained from digested proteins ("Bottom up" proteomics), using liquid chromatography (LC) coupled with tandem mass spectrometers (LC-MS-MS) with, for example, Electrospray Ionisation ion sources (ESI ion sources).

In "Bottom up" proteomics, the mixture of proteins to be analysed is cleaned and digested with cleavage reagents such as trypsin, cyanogen bromide, or the like, to produce peptides before the LC separation.

This approach involves the LC separation of the peptides, and for each LC peak, the production of the primary MS spectrum of the peptides after their ionization (precursor ions) followed by the dissociation of selected peptides and the production of their MS-MS spectra with the tandem mass spectrometer, and the identification by protein sequence database searching of the selected peptides (and their parent proteins) with the produced MS-MS spectra.

During an LC-MS-MS acquisition with a sample containing a small number of proteins, each peptide (precursor) in the MS spectrum can be selected to produce a corresponding MS-MS spectrum.

But in complex protein sample analysis, the MS-MS throughput of the LC-MS-MS method is clearly limited by the time needed to successively acquire the MS-MS spectrum of each selected precursor of the MS spectrum, within the limited elution duration of the LC peak, which typically lies between 1 to 30 seconds.

Therefore, only a portion of the peptides (and parent proteins) can be identified during the LC-MS-MS analysis of a complex mixture of proteins.

The most common approach used to select the limited number of precursors to produce the corresponding MS-MS spectra after each LC peak is the "data dependant" analysis in which the most intense MS peaks of MS spectrum are automatically first selected for MS-MS.

Generally, the database search is carried out by using the simplified MS and MS-MS spectra described above. The database search can also be performed with a pre-treatment of the MS-MS spectra such as a "sequence tagging" in which only small parts of the amino acid sequences ("Tags") are produced or with "De Novo Sequencing" in which the complete amino acid sequence is directly calculated from the MS-MS spectra.

The database search is commonly performed by automatic computer search using scoring methods such as with Mascot or Sequest search tool, or the like.

Many protein databases such as Swissprot, NCBInr, MSDB, or the like, can be used for the automatic computer search.

During the database search, the proteins of the database are electronically digested ("In silico digestion") with the same cleavage reagent used by the user for the LC-MS-MS data production. A peptide list comprising peptides corresponding to each digested protein is produced. A sub-list of potential peptide candidates is selected for each experimental MS precursor selected during the LC-MS-MS data production, within the MS accuracy chosen by the user.

All the possible peptide fragmentation patterns of each potential peptide candidate are calculated to produce a corresponding theoretical MS-MS spectrum as function of the parameters chosen by the user for the LC-MS-MS analysis (MS, and MS-MS accuracy, fragmentation energy, tandem mass spectrometer used, type of fragment ions produced, etc.).

The fragment ions of each experimental MS-MS spectrum are then compared with the fragment ions of the theoretical MS-MS spectra.

A list of identified peptide candidates (and corresponding proteins) is generated with corresponding identification scores for each MS-MS spectrum submitted to the database search. The highest score corresponds normally to the best candidate identification.

A final list of identified protein candidates combining all the identified peptides with the highest score identification (normally the best identified peptide candidate of each MS-MS spectrum) of the complete LC-MS-MS acquisition of the analyzed sample is produced, after the selection of a peptide score threshold by the user.

The final list of peptide candidates (and corresponding proteins) comprises positive identifications with scores above score threshold. This final list does not only contain the true positive identifications of peptide candidates (and corresponding proteins), but also false positive identifications of peptide candidates.

The identifications below the score threshold are false negative and true negative identifications.

Many reasons give rise to the undesirable false positive and true negative identifications such as poor quality MS-MS spectra, selection of peptides corresponding to protein with post translational modification (PTM) not including in the search parameters, etc.

The protein composition of the analyzed sample is generally unknown, or only partially known, by the user. Therefore the number of false positive identifications in the final peptides (and corresponding proteins) list cannot be determined individually but by using statistic methods such as decoy database searches.

The decoy database is built from the real database. The proteins of the decoy database are obtained by reversing or randomising the amino acid sequences of the proteins of the real database. The decoy database search is performed using identical search parameters as in the real database search.

The positive identifications of the real database searches give the number of true positive plus false positive identifications, and the positive identifications of the decoy database searches using the same search parameters and score threshold conditions give an estimation of the number of false positive identifications in the real database searches.

The confidence level in the peptide (and corresponding protein) identifications is given by the FDR (False Discovery Rate) value defined by the ratio of the number of positive identifications of the decoy database searches divided by the number of positive identifications of the real database searches. Lower the FDR is, higher the confidence level of identification is.

The user can decrease the FDR value by simply increasing the score threshold. More sophisticated analyses can be used such as selecting positive protein identifications for which at least two different peptides have been identified In LC-MS-MS of complex samples of proteins, more than one precursor are very often selected inadvertently with a mass selection window around the mass of the given precursor that is aimed at for producing an MS-MS spectrum.

The fragment ions of the plurality of selected precursors increase the complexity of the produced MS-MS spectrum, and can decrease the identification score obtained by the database search using scoring methods for the given precursor.

Furthermore, the database search is generally performed only for the given MS precursor, the peak of which is the most intense, and the other selected precursors are not considered.

Different solutions have been proposed to increase the MS-MS throughput of tandem mass spectrometry by simultaneously producing several MS-MS spectra.

A first solution is the simultaneous hardware production of several MS-MS spectra, each MS-MS spectrum corresponding to a standard MS-MS spectrum of a single precursor selected in the MS spectrum. The MS-MS spectra which are produced simultaneously are spatially (MS-MS) and temporally (MS) separated [1] [2].

Another solution is the production of multiplexed MS-MS spectra produced from a plurality of precursors selected in the MS spectrum per multiplexed MS-MS spectrum. The fragment ions of the selected precursors are deliberately mixed.

Individual MS-MS spectra, each corresponding to a single selected precursor can be produced from the analysis of the multiplexed MS-MS spectrum by using different methods of fragment-precursor identifications [3] [4] [5] [6] [7].

In the references [3] [4] [5] [6] [7], all the methods of fragment-precursor identifications use comparison of at least two (or more) multiplexed MS-MS spectra of the same plurality of precursors. These MS-MS spectra are successively produced with a modification of one experimental parameter of the used tandem mass spectrometer between two successive MS-MS acquisitions.

All the solutions described above [1] [2] [3] [4] [5] [6] [7] are hardware solutions. They depend on the type of tandem spectrometers used, and cannot be extended to other existing tandem mass spectrometers.

Purely software solutions for analyzing deliberately or inadvertently multiplexed MS-MS spectra have also been proposed [8] [9] [10] for "Bottom up" proteomics. These solutions [8] [9] [10] do not specifically depend on the type of tandem mass spectrometer, and need the production of only one multiplexed MS-MS spectrum of the plurality of selected precursors for fragment-precursor identifications. But high accuracy for both MS and MS-MS are needed for these methods.

The precursor-fragment identification method of reference [8] consists in submitting the multiplexed MS-MS spectra with the mass-to-charge values and charges of the plurality of selected precursors to database searches, without any previous algorithmic analysis of the multiplexed MS-MS spectra.

This MS-MS multiplexed method is limited by MS-MS accuracy and the number of detected fragments [8]. It can be efficiently used only for tandem mass spectrometers with high MS-MS accuracy such as FT-MS (Fourier Transform Mass Spectrometers).

The identification scores of the plurality of selected precursors of the multiplexed MS-MS spectrum analyzed by database searches using scoring methods decrease when the number of selected precursors increases.

This decreasing score effect is worse with a large intensity dynamic range in the MS spectrum between the plurality of selected precursors of the analyzed multiplexed MS-MS spectrum, because the existing scoring methods generally select the most intense peaks of the multiplex MS-MS spectrum for the database searches.

For example, when a small intensity peak of the MS spectrum is selected with a larger one, the database search of the corresponding multiplexed MS-MS spectrum using scoring methods can only identify the precursor corresponding to the larger intensity peak of the MS spectrum with a good score, and will produce low score or no identification for the precursor corresponding to the smaller one.

The multiplexed MS-MS methods of the references [9] [10] enable database searches with existing scoring methods using an algorithmic fragment filter for precursor-fragment identifications, before the submission to database searches.

The algorithmic fragment filter used [9] [10] is based on the identification of the complementary fragment ion pairs or multiplets in the multiplexed MS-MS spectrum corresponding to different dissociation pathways of each selected precursor. The sum of the masses of the fragment pairs or multiplets within the MS-MS accuracy equals to the mass of the corresponding selected precursor.

The multiplexed MS-MS methods of the references [9] [10] can be efficiently used only by high MS-MS accuracy tandem mass spectrometers so that the number of false complementary fragment ion pair identifications is limited. The false complementary fragment pair or multiplet identifications decrease the identification scores of the database searches.

The identification scores obtained with the multiplexed MS-MS methods of the references [9] [10] are also limited by the number of fragment MS-MS peaks identified by the software fragment filter used, because only a portion of the fragment ions of each selected precursor forms fragment pairs and can be identified in the corresponding multiplexed MS-MS spectrum.

The number of MS-MS spectra successively produced by using MALDI (Matrix Assisted Laser Desorption Ionisation) ion sources is not limited by the elution time as with LC-ESI-MS-MS, but by the ablation of the surface of the target by the laser shots.

The limitations of tandem mass spectrometry described before do not only relate to applications in "Bottom up" proteomics, but also concern "Top Down" proteomics using undigested proteins, and small molecule applications such as in metabolomics, or in identification of pollutants.

SUMMARY OF THE INVENTION

An aim of the invention is therefore to overcome the drawbacks of the state of the art as presented above to increase the MS-MS throughput of tandem (MS-MS) spectrometry using multiplexed MS-MS spectra and real and decoy database searches with scoring methods to improve precursor identifications.

In particular, one aim of the invention is to propose a method of multiplexed tandem (MS-MS) mass spectrometry compatible with all tandem mass spectrometers.

The present provides for this purpose a method as recited in claim 1.

This method enables identification of a plurality of precursors, which simultaneously selected to produce a multiplexed MS-MS spectrum, after an identification of the corresponding fragment ions.

A first plurality of individual MS-MS spectra corresponding to each selected precursor is produced with or without previous fragment filtering from the multiplexed MS-MS spectrum.

The first plurality of individual MS-MS spectra is then submitted to database searches without score threshold condition.

Each individual MS-MS spectrum is sent to first real and decoy database searches using scoring methods without score threshold condition.

All the positive identifications of the first real and decoy database searches are used to construct corresponding corrected real and decoy MS-MS spectra.

More specifically, the fragment ions of the multiplexed MS-MS spectrum are compared to fragment ions of theoretical real and decoy MS-MS spectra calculated from the identified precursors, for which a positive identification has been obtained from the first real and decoy database searches.

Then, each of the corrected real MS-MS spectra is sent to a second real database search using scoring methods with score threshold condition and each of the corrected decoy MS-MS spectra is sent to a second decoy database search using scoring methods with score threshold condition.

An FDR (False Discovery Rate) value, which gives an estimation of false positive identifications of the real database search, is determined using the positive identifications above the score threshold of both second real and decoy database searches.

Others features are presented in the dependent claims as well as the other independent claims.

BRIEF DESCRIPTION OF THE DRAWINGS

Other aspects, aims and advantages of the invention will more clearly appear from the following description of the invention, which is provided by way of a non-limiting example and with reference to the appended drawings in which.

DESCRIPTION OF PREFERRED EMBODIMENTS OF THE INVENTION

First of all, it is recalled that what is meant by a multiplexed dissociation mass (MS-MS) spectrum is a dissociation mass (MS-MS) spectrum produced with a plurality of precursors selected in the primary (MS) mass spectrum where the fragment ions of the selected precursors are mixed.

The peaks of the individual MS-MS spectra that would be obtained if each of the selected precursors were analysed separately from the other are consequently mixed in the generated multiplexed MS-MS spectrum.

Figure 1:
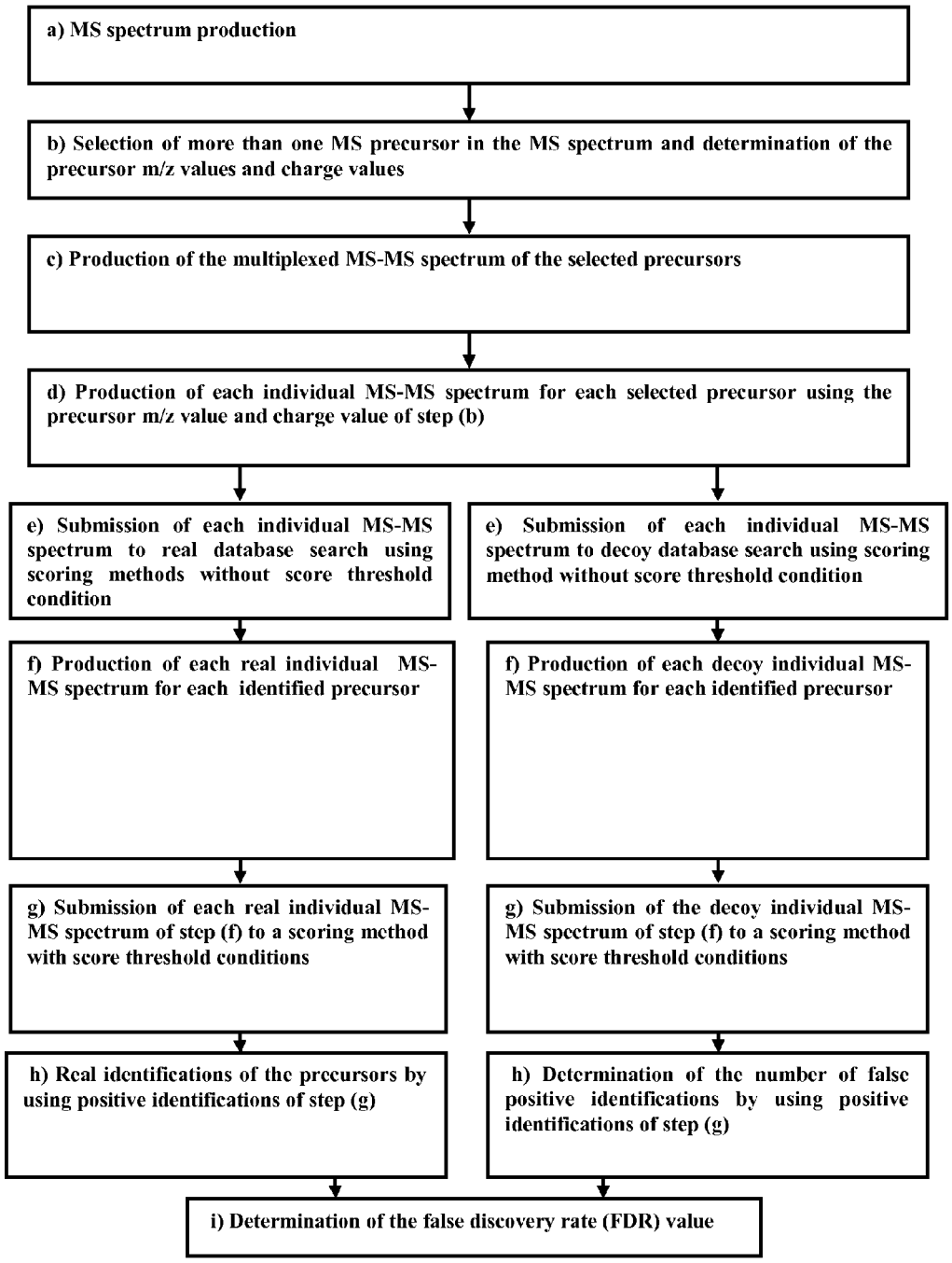
FIG. 1 is a flow chart of a preferred method of implementation of the multiplexed tandem spectrometry method of the invention.

Referring to FIG. 1 in particular, in the method of the invention, implemented with whichever mass spectrometer, the first step (a1) comprises supplying a primary (MS) mass spectrum for precursors after they have been ionized. The precursors are obtained from molecules that are to be identified.

The primary mass spectrum can be obtained, as known by the skilled person, by the ionization of the molecules to be identified in a ion source of charged ions, and acceleration with a substantially electric field, before their injection into the tandem mass spectrometer, in order to generate the primary (MS) mass spectrum of precursor, without dissociation, wherein said MS spectrum contains primary ions peaks.

The primary MS spectrum can also be obtained by reading it from a database, such as a third-party database, in which it was previously saved.

As known by the person skilled in the art, in step (a2) a simplified MS spectrum is generally produced containing a list of mass-to-charge ratio m/z and corresponding maximum intensity values of each peak of the primary MS spectrum. Ion charge values are also added to the list when they can be determined.

Steps (a1) and (a2) can be jointly referred to hereafter as step (a).

In step (b), a plurality of precursors are deliberately or inadvertently selected from the primary MS spectrum, and the mass-to-charge ratio (m/z) values and charge values of each of the selected precursors are determined from the primary MS spectrum of the step (a) or from a mass selection window used.

In step (c1), the plurality of selected precursor ions are dissociated into fragment ions in the tandem mass spectrometer and a multiplexed MS-MS spectrum of the plurality of selected precursors is produced with the fragment ions by the tandem mass spectrometer and comprises peaks corresponding to detection of one or more fragments of the selected precursors.

In step (c2), a simplified multiplexed MS-MS spectrum is produced as a list of mass-to-charge ratio values m/z and the corresponding maximum intensity values of peaks of the multiplexed MS-MS spectrum. Possibly, ion charge values, when they are known, are added to the list.

The multiplexed MS-MS spectrum can also be obtained by reading it from a database, such as a third-party database, in which it was previously saved.

Steps (c1) and (c2) can be jointly referred to hereafter as step (c).

In step (d), a plurality of individual MS-MS spectra are produced from the multiplexed MS-MS spectrum of step (c). Each individual MS-MS spectrum corresponds to only one precursor selected from the MS spectrum.

Each individual MS-MS spectrum comprises mass-to-charge ratio (m/z) values, the corresponding maximum intensity values, and charge values (when determined) of the simplified multiplexed MS-MS spectrum, the mass-to-charge ratio values m/z and charge values (when determined) values corresponding to the only one precursor selected from the MS spectrum.

The individual MS-MS spectra of step (d) can also be produced after filtering the fragment ions of the simplified multiplexed MS-MS spectrum.

Without filtering of fragment ions, for each selected precursor, the individual MS-MS spectrum of step (d) is identical and corresponds exactly to the simplified multiplexed MS-MS spectrum of step (c).

With filtering of fragment ions, only the fragment ions of the simplified multiplexed MS-MS spectrum selected by the fragment filter are used to produce each individual MS-MS spectrum of step (d).

Filtering techniques become more useful for the method of the invention to clarify the individual MS-MS spectra produced in step (d) as the number of selected MS precursors increases.

The method of the invention is compatible with all possible techniques of fragment ion filtering dependent or not on the precursor mass. Non limiting examples of fragment ion filtering are "sequence tagging", "De Novo Sequencing" or the complementary fragment pair and multiplet technique [9] [10].

In step (e), each of individual MS-MS spectrum of step (d) is submitted to a first real database search using scoring method without score threshold condition, and to a corresponding first decoy database search using the same search parameters as for the first real database search.

In the sense of the invention, without score threshold condition should be understood that all identifications obtained by the database searches are taken into consideration without considering the scores obtained for each identifications.

The results of the real and decoy database searches identify candidate precursors. These candidate precursors will be further confirmed or infirmed as later described.

As a variant, the scoring method is carried out with low score threshold condition, this low score threshold condition is lower that conventionally used score threshold condition, such as lower than 10 or more advantageously lower than 5. As known by the person skilled in the art, decoy database search is generally used in proteomics applications to estimate the number of false positive peptides (and corresponding proteins) identifications among the positive identifications of the first real database search.

The confidence level in the peptide and corresponding protein identifications is given by the FDR (False Discovery Rate) value. The FDR value is defined by the ratio of the number of positive identifications from the decoy database search divided by the number of positive identifications from the real database search. Lower the FDR is; higher the confidence level of identifications is.

Unlike standard analysis, the method of the invention in the steps following the step (e) uses all the positive identifications of the database search including the ones normally rejected below the threshold score values used in standard analysis.

In step (f), for the individual MS-MS spectra for which the real, respectively decoy, database search produces positive identifications, real, respectively decoy, individual MS-MS spectra are produced from these positive identifications. The real and decoy individual MS-MS spectra can be referred to as "corrected" individual MS-MS spectra.

A real individual MS-MS spectrum comprises the mass-to-charge ratio (m/z) values and corresponding maximum intensity values of fragment ions of a candidate precursor resulting from the real database search of step (e).

A decoy individual MS-MS spectrum comprises the mass-to-charge ratio (m/z) values and corresponding maximum intensity values of fragment ions of a candidate precursor resulting from the decoy database search of step (e).

In a first embodiment of step (f), for producing a corrected individual MS-MS spectrum, a list of mass-to-charge ratio m/z values is computed from the candidate precursor identified in step (e). The mass-to-charge ratio m/z values correspond to theoretical fragment ions of the candidate precursor. Then all the fragment ions of the multiplexed MS-MS spectrum, of which the mass-to-charge ratio (m/z) value is comprised in the list, are selected to produce the corrected individual MS-MS spectrum. Thus, the selection is done within the instrumental MS-MS accuracy.

In a second embodiment of step (f), a real, respectively decoy, individual MS-MS spectrum is produced by selecting fragment ions in the simplified multiplexed MS-MS spectrum, which match the fragment ions of the candidate precursor, the fragment ions of the candidate precursor being identified in step (e) using the real, respectively decoy, database search.

This second embodiment of step (f) reduces the duration of the corrected individual MS-MS spectra production of this step. However, some fragment ions can be ignored in the identification of the first database search due to parameters of search algorithms used such as too low MS-MS peak intensity, compared with the previous calculated comparison.

Two different sets of corrected individual MS-MS spectra, corresponding respectively to the real and decoy database search results of step (e), are produced in step (f).

In a first embodiment of step (g), the two sets of corrected individual MS-MS spectra of step (f) and the corresponding precursor m/z values and charge values are submitted to real and decoy database searches using scoring methods with identical score threshold conditions, and identical search parameters, both in the real and decoy database searches.

That is, the set of real, respectively decoy, individual MS-MS spectra is submitted to a second real, respectively decoy, database search.

The database searches of step (g) can be performed with the same scoring method and databases used in step (e), or with other scoring methods and/or databases. The best result is obtained by using the same scoring method and databases for steps (e) and (g).

The database searches of step (g) are not standard but specific to the method of the invention. Indeed real and decoy database searches do not use the same set of individual MS-MS spectra, but two different sets of individual MS-MS spectra each one corresponding respectively to the results of the real and decoy database search of step (e).

A standard database search method using the same set of individual real MS-MS spectra produced from the positive identifications of the first real database search of step (e) for subsequent real and decoy database searches underestimates false positive identifications of the second real database search due to bias effects.

The correct statistical estimation of the false positive identifications is obtained with step (g) of the method with the two different sets of corrected individual MS-MS spectra for the real and decoy database searches.

In a second embodiment of step (g), this step is performed using scoring methods with a score threshold on the two sets of corrected individual MS-MS spectra of step (f) and the identification results of the first real and decoy database searches of step (e), without second real and decoy database searches.

A non-limiting example of such a scoring method is the production of an identification score for each corrected individual MS-MS spectrum. The identification score is obtained by dividing the number of fragment ions of the corrected individual MS-MS spectrum by the number of all theoretically possible fragment ions determined from the candidate precursor identified in step (e).

The second embodiment of step (g) avoids second database searches, thus shortening the process.

Back to the first embodiment, in step (h) the precursors of the multiplexed MS-MS spectrum are identified by using the positive identification results of the real database searches of step (g) which are above a chosen score threshold, and the number of false positive identifications are estimated with the number of positive identifications of the decoy database searches of step (g) above the score threshold. Score identification threshold conditions and search parameters are identical for the real and decoy database searches.

In the second embodiment, i.e. without second database search of step (g), in step (h) the positive precursor identifications are obtained by selecting identifications above the score threshold used for the scoring method of step (g) with the set of real individual MS-MS spectra.

The false positive identifications are estimated by selecting identifications above the same score threshold used for the scoring method of step (g) with the set of decoy individual MS-MS spectra.

In the first embodiment, in step (i) the FDR (False Discovery Rate) value, which gives the confidence level of precursor positive identifications of real database searches, is determined by the ratio of the number of positive identifications of the decoy database search of step (h) divided by the number of positive identifications of the real database search of step (h).

In the second embodiment, in the step (i), the FDR (False Discovery Rate) value, which gives the confidence level of precursor positive identifications is determined by the ratio of the number of positive identifications obtained in step (h) with the set of decoy individual MS-MS spectra divided by the number of positive identifications obtained in step (h) with the set of real individual MS-MS spectra.

As in standard analysis, steps (e) to (i) of the method of the invention can successively be carried out with different scoring methods and with different databases by using Mascot, Sequest, X!Tandem, or others. The precursor positive identifications obtained by the different search tools can be combined to increase the number of precursor positive identifications.

The FDR value can be selected by the user simply by choosing the corresponding score threshold, or by using more complex conditions, such as for example in "Bottom up" proteomics using LC-MS-MS data, the combination a score threshold value for peptide identifications, and at least two peptides identified per protein for protein identifications.

It is understood that the concrete implementation of the method of the invention can be typically achieved by a digital computer such as a DSP (Digital Signal Processor) executing the appropriate programs.

More practically, the present invention can be embodied in the form of a software module that is added to any existing tandem mass spectrometry device, and interfaced with the other software of this equipment.

In any case, the person skilled in the art will understand that production of the primary MS spectrum and of the multiplexed MS-MS spectra obtained with tandem mass spectrometry provides the possibility of identifying the selected precursors by using the method of the invention.

Compared with standard analysis using one precursor per multiplexed MS-MS spectrum produced, the MS-MS throughput and the corresponding precursor identifications of the method are increased proportionally to the number of precursors selected for each multiplexed MS-MS spectrum.

As a non-limited example, if three precursors are selected in average per multiplexed MS-MS spectrum produced, the final MS-MS throughput is improving by a factor three by using the method of the invention.

Steps (f) to (i) of this method transform a significant proportion of true negative identifications (scores below the score threshold) obtained with the standard MS-MS method into true positive identifications (scores above the score threshold).

The method of the invention does not depend on the mass spectrometry technique used to measure the mass-to-charge ratio m/z values of the primary and fragment ions, and the mass-to-charge ratio m/z values can be measured using time-of-flight, deflection in a magnetic field, frequency, etc.

The method of the invention is compatible with all types of tandem mass spectrometers, and can be performed both at low and high MS and MS-MS resolution and accuracy.

As in standard analysis, when considering the same number of multiplexed MS-MS spectra produced, the method of the invention produces more precursor positive identifications at higher MS and MS-MS resolution and accuracy compared with lower MS and MS-MS resolution and accuracy, due to the lower false positive identifications produced by the database searches.

It should be noted that in all the present description, mass-to-charge ratio (m/z) values can be replaced with mass values and vice versa.

Components and Operation of Tandem Mass Spectrometers Implementing the Method of the Invention Now will be described in greater detail, and by way of non-limiting examples some preferred tandem mass spectrometer components and operations implementing the multiplexed tandem mass spectrometry method of the invention.

Figure 4:
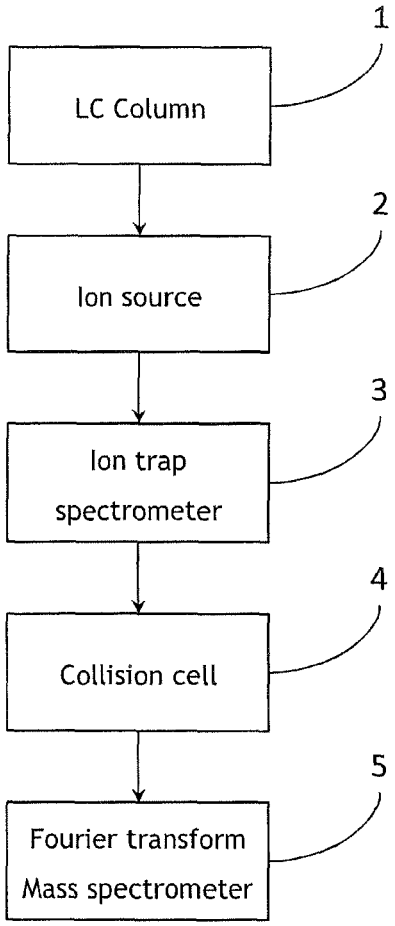
FIG. 4 shows, a block diagram of one example of a mass spectrometer suitable for the implementation of embodiments of the method of the invention.

A non limited example of tandem mass spectrometer suitable for the implementation of the method of the invention is shown in the FIG. 4.

The analysis of complex sample with tandem mass spectrometers generally requires separation techniques 1 of the molecules of the sample before the introduction into the tandem mass spectrometer.

After the separation phase the molecules of the analyzed sample are introduced in the ion source 2 to be ionized.

The primary ions are introduced into the mass spectrometer 5 to produce the primary MS spectrum after their ionization in the ion source 2.

After the production of each MS spectrum, the primary ions of interest are selected as precursors in the MS spectrum by the precursor mass selector 3 to produce the multiplexed MS-MS spectra.

The selected primary ions are fragmented in the dissociation device 4 to produce the fragment ions used to produce the multiplexed MS-MS spectra.

The fragment ions are introduced into the mass spectrometer 5 to produce the multiplexed MS-MS spectra.

The method of the invention can be implemented with all existing tandem mass spectrometers known by the person skilled in the art, composed of two mass spectrometers operating sequentially in space separated by a dissociation device or a single mass analyzer operating sequentially in time.

The existing tandem mass spectrometers with spatial separation which can be used with method of the invention are Q-q-MS tandem mass spectrometers, where Q is a quadrupolar mass spectrometer used as precursor MS selector 3, q is the dissociation device 4, generally a multipolar waveguide containing gas using CID (Collision Induced Dissociation) dissociation technique, and MS is a TOF (Time of Flight) mass spectrometer 5 using orthogonal injection system (OTOF), or a quadrupolar (Q) mass spectrometer 5, or a FT-ICR (Fourier Transform Ion Cyclotron Resonance) mass spectrometer 5 that uses a static magnetic field, or a linear Ion Trap (IT) mass spectrometer 5.

The MS and the multiplexed MS-MS spectra are produced in the second mass spectrometer used (Q, TOF, IT, or FT-ICR).

The first quadrupolar Q is used for the selection of the precursor ions in the MS spectrum to produce the multiplexed MS-MS spectra after the dissociation of the selected primary ions in multipolar waveguide q by CID (Collision Induced Dissociation), or another technique of fragmentation.

Other tandem mass spectrometers with spatial separation which can be used with the method of the invention are MALDI-TOF-TOF, equipped with MALDI (Matrix Assisted Laser Desorption Ionization) ion source, and composed of a first linear TOF (Time-Of-Flight) mass spectrometer with a Bradbury-Nielson temporal gate used as MS selector 3, a collision cell for dissociation by using high kinetic energy CID 4, and a second axial TOF mass spectrometer with reflectron (RTOF) 5.

The MS and MS-MS spectra are produced in the second RTOF mass spectrometer. The Bradbury-Nielson temporal gate is used for the selection of the precursor ions in the MS spectrum after TOF separation in the first linear TOF mass spectrometer, and the selected precursor ions are dissociated in the collision cell by high kinetic energy CID, to produce the multiplexed MS-MS spectra of the selected precursor in the second RTOF mass spectrometer.

The existing single tandem mass spectrometers operating sequentially in time which can be used with method of the invention are linear 2D or 3D Ion trap (IT) mass spectrometers or Fourier Transform (FT-MS) mass spectrometers (FT-ICR or Orbitrap®).

The MS spectrum production, the precursor selection, the dissociation of the precursor ions by CID or another dissociation technique, and the MS-MS spectrum production are produced successively in the IT or the FT-MS mass spectrometer used, as known by the skilled person in the art.

Other existing tandem mass spectrometers IT-MS are combining spatial separation and sequentially time operations, with a 3D ion trap as IT and an axial or orthogonal injection RTOF as MS mass spectrometer, and with a linear 2D ion trap as IT and a FT mass spectrometer (FT-ICR or Orbitrap) as MS mass spectrometer.

The MS spectra are produced in the axial or orthogonal injection RTOF or in the FT mass spectrometers, the precursor ions selection and dissociation phases are successively produced in the 3D and 2D IT, and the MS-MS spectra are finally produced in the IT used, or in the MS mass spectrometer (axial or orthogonal injection RTOF, or FT-MS).

The existing single tandem mass spectrometers operating sequentially in time described above can produce successive multiplexed MS-MS spectra of successive selected MS-MS peaks in the $MS^n$ mode as known by the person skilled in the art.

The method of the invention is well suited for applications using liquid chromatographic (LC) as separation technique 1 (LC-MS-MS). But the method of the invention is compatible with all existing methods of separation of the molecules studied before the introduction in tandem mass spectrometers such as 1D or 2D gel electrophoresis (PAGE) separation.

As non limited examples, LC is generally coupled with ESI (Electrospray Ionization) ion sources, and 1D or 2D PAGE is generally used with MALDI (Matrix Assisted Laser Desorption Ionisation) ion sources.

The method of the invention can be used with all existing ion sources 2. The ion used source can be an ESI (Electro-Spray Ionization) ion source, a MALDI (Matrix Assisted Laser Desorption Ionization) pulsed laser ion source, a DESI (Desorption Electrospray Ionization) ion source, an APCI (Atmospheric Pressure Chemical Ionization) ion source, an APPI (Atmospheric Pressure Photo Ionisation) ion source, a DART (Direct Analysis in Real Time) ion source, a LDI (Laser Desorption Ionization) ion source, an ICP (Inductively Coupled Plasma) ion source, en EI (Electron Impact) ion source, a CI (Chemical Ionization) ion source, a FI (Field Ionization) ion source, a FAB (Fast Atom Bombardment) ion source, a LSIMS (Liquid Secondary Ion Mass Spectrometry) ion source, an API (Atmospheric Pressure Ionization) ion source, a FD (Field Desorption) ion source, a DIOS (Desorption Ionization On Silicon) ion source, or any other type of ion source producing primary ions.

As known by the skilled person in the art, the most commonly precursor mass selectors 3 used in tandem mass spectrometers are: quadrupolar (Q), linear 2D or 3D ion trap (IT), Bradbury-Nielson temporal gate, Fourier Transform mass spectrometers (FT-ICR and Orbitrap).

The fragmentation in the dissociation device 3 for the production of the multiplexed MS-MS spectra by the tandem mass spectrometers using the method of the invention can be implemented with a collision chamber containing gas that allows dissociation by CID/CAD (Collision Induced Dissociation/Collision Activated Dissociation), a time-of-flight space allowing spontaneous dissociation (PSD or Post Source Decay) after increasing the internal energy of the primary molecule ionised in the ion source or over the time-of-flight path by photo ionisation, or with the SID (Surface Induced Dissociation) technique, the ECD (Electron Capture Dissociation) technique, the ETD (Electron Transfer Dissociation) technique, the IRMPD (Infra Red Multi Photon Dissociation) technique, the PD (Photo Dissociation) technique, the BIRD (Back Body Infra Red Dissociation) technique, or again any method of fragmentation of the primary ions.

Different techniques of production of multiplexed MS-MS spectra necessary to the method of the invention the can be used by the existing tandem mass spectrometers described above.

The first one is the In-Source-Dissociation (ISD) method where the primary ions of all the different type of precursors are fragmented in the ion source 2 before the injection into the mass spectrometer without any primary mass selection in the MS spectrum.

The ISD method can be used with MALDI ion sources for Top down (pure proteins) or Bottom up (peptides) analysis of protein samples by producing prompt fragmentation in the MALDI ion source by increasing the laser power density on the MALDI target.

It can be used also with ESI ion sources for Top down (pure proteins) or Bottom up (peptides) analysis of protein samples by using collision fragmentation with a gas of the multi charged ions produced by the ESI ion sources, before the injection in the mass spectrometer.

The second technique of production of multiplexed MS-MS spectra consists in increasing the width of the precursor mass selection window of the mass spectrometer used to select more than one precursor in the primary MS spectrum instead of only one precursor.

All the existing tandem mass spectrometer described above can use this method of multiplexed MS-MS spectra production by using broader mass selection window for precursor MS peak selection.

Considering that the minimum width of the precursor mass selection windows used in the existing tandem mass spectrometer is typically about of 0.1-0.2% of the selected precursor mass value, and that in practical applications it can be typically of 0.5-1% of the selected precursor mass value, a significant fraction of the MS-MS spectra produced in standard tandem mass spectrometry are generally multiplexed MS-MS spectra with more than one precursor selected.

Therefore, the method of the invention can be also used for the analysis of standard tandem mass spectrometry data.

The third technique of production of multiplexed MS-MS spectra is the successive dissociation of several different precursors individually selected, adjacent or not to the other selected precursors, by a primary mass selection window of the mass spectrometer used, before producing the single multiplexed MS-MS spectrum of the mixtures of the fragments of all the individually selected precursors.

The Q-q-MS tandem mass spectrometer described above where MS is a linear 2D IT (LIT) or a FT-ICR, can use the third method of multiplexed MS spectra production.

The Q-q-LIT spectrometer can select successively each precursor MS with the Q, fragment the selected precursor in the q, and stored successively the dissociated fragment ions of each selected precursor in the LIT, before to produce the corresponding single multiplexed MS-MS spectrum of the fragment mixture in the LIT.

The Q-q-FT-ICR spectrometer can select each precursor with the Q, fragment the selected precursor in the q, and store successively the dissociated fragment ions of each selected precursor in the q, before injecting the mixture of the dissociated fragments of all the selected precursors in the FT-ICR, to produce the corresponding single multiplexed MS-MS spectrum of the fragment mixture.

The IT-MS spectrometer, where IT is a linear ion trap and MS is a Fourier transform mass spectrometer (FT-ICR or Orbitrap®) 5 described above, can also use the third method of multiplexed MS-MS spectrum production.

Each precursor is successively selected by the IT before to be fragmented in the IT or in another external collision cell, the fragment ions of the plurality of the different selected precursors are finally stored in an intermediate cell, before to be injected altogether in the FT-MS (FT-ICR or Orbitrap) to produce the multiplexed MS-MS spectrum.

The MALDI-TOF-TOF mass spectrometer described above can also use the third method of multiplexed MS-MS spectrum production.

Instead of selecting only one precursor in the MS spectrum at each laser shot on the MALDI target, the primary ions of several different precursor can be selected successively at each laser shot with the Bradbury-Nielson temporal gate after their separation in the first linear TOF spectrometer, to produce the multiplexed MS-MS spectrum of the different selected precursors by the accumulation of the detected fragments of all the laser shots. The method of the invention is compatible with all the different types of fragment ions produced by using all the existing fragmentation techniques known by the person skilled in the art, such as a, b, c, y, z, x, or w fragment ions.

A non-limiting application of the method of the invention is the analysis of complex samples of peptides (Bottom-up proteomic) and pure proteins (Top-down proteomic) by using LC-ESI, 2D PAGE-MALDI, or LC-MALDI with tandem mass spectrometers by using database searches with scoring methods using search tools such as Mascot or Sequest.

The method of the invention can be used also for small molecule applications such metabolomics, or the identification of impurities or pollutants.

First Example

Now, a non-limiting first example of implementation of the method of the invention will be described with reference to FIG. 4.

A protein sample of *Escherichia Coli* was prepared, as known by the skilled person in the art, for LC-MS-MS analysis by using LC-ESI-Q-q-TOF mass spectrometer.

100 ng of the protein sample was digested using trypsin to generate a mixture of peptides before the injection in the LC capillary column 1. Effluent from the LC column 1 was electrosprayed by the ESI ion source 2 into the used Q-q-TOF mass spectrometer to produce the MS and the multiplexed MS-MS spectra of the peptide mixture.

During the elution time, at each LC peak, MS spectra have been produced, each MS spectrum following by the corresponding MS-MS spectra, containing multiplexed MS-MS spectra, by using the Q-q-TOF mass spectrometer, as described above for the second technique of MS-MS production.

Each MS spectrum is produced in the RTOF mass spectrometer 5, after the selection of the precursors with the quadrupolar mass spectrometer 3. The selected primary ions are dissociated by CID in the collision cell q 4, before to be injected in the RTOF mass spectrometer 5 to produce each multiplexed MS-MS spectrum.

The width of the mass selection window used for the precursor selection in the primary MS spectrum was about 0.5-1% of the mass-to-charge ratio (m/z) value of the selected precursor, and was similar to the ones used in standard LC-MS-MS.

The MS and MS-MS accuracy used in the analysis was 20 ppm.

Figure 2:
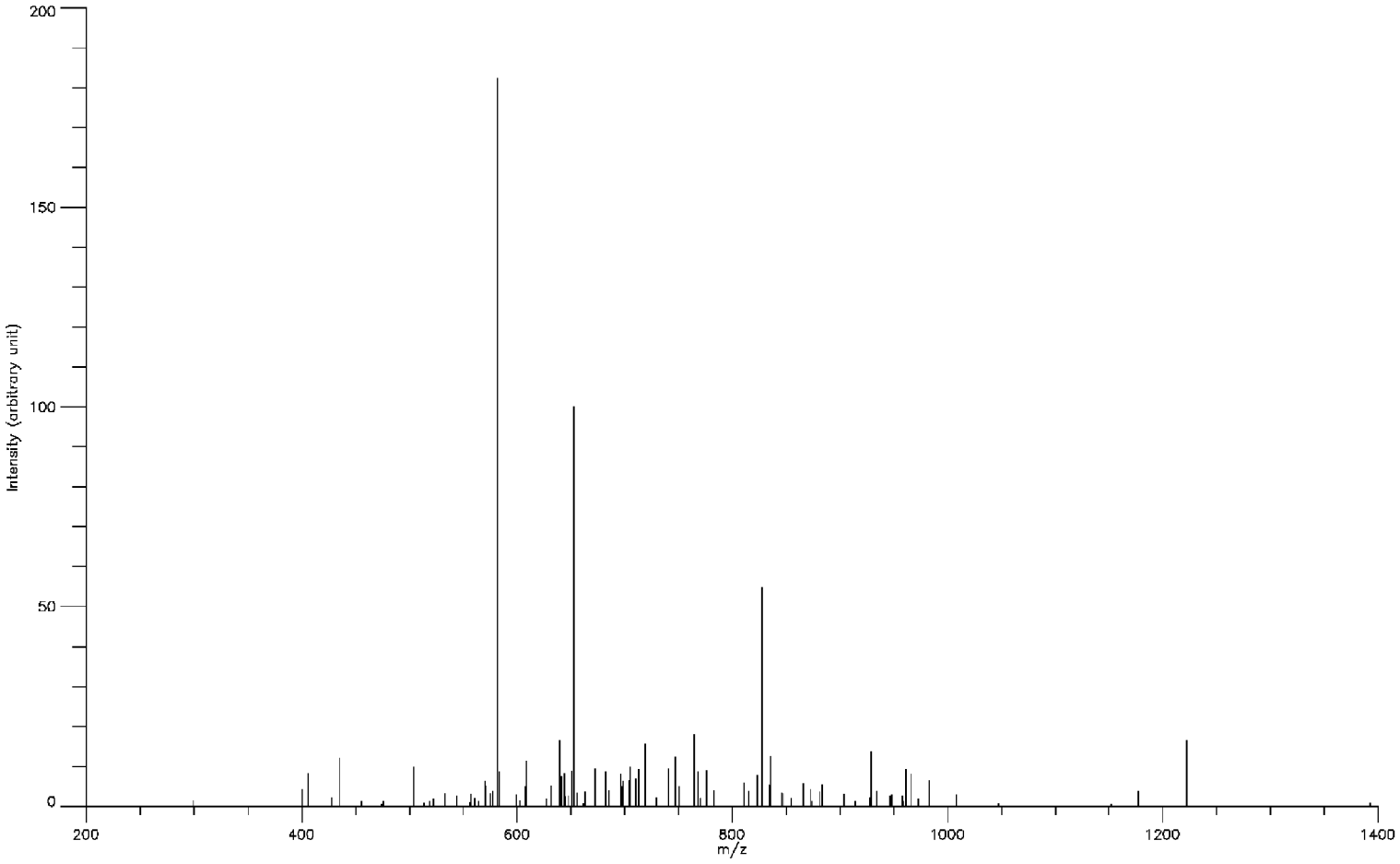
FIG. 2 is an example of a simplified MS spectrum of peptides from a LC peak produced by a LC-MS-MS acquisition of *Escherichia Coli* protein sample, where the mass-to-charge ratio m/z values in Dalton (Da) are on the abscissa axis and the corresponding maximum intensity values on the ordinate axis.

FIG. 2 shows an example of simplified MS spectrum corresponding to the list of MS mass-to-charge ratio (m/z) values and corresponding maximum intensity values presented in table 1 obtained from a primary MS spectrum containing the MS peaks of peptides from a LC peak produced by the LC-MS-MS acquisition of the *Escherichia Coli* protein sample and corresponding to step (a) of the method according to the invention.

In the particular case of multi-charged primary ions, the charge of the precursor ions, if determined, is added to the mass-to-charge ratio m/z and the corresponding maximum intensity value list, as shown in the example of table 1.

The person skilled in the art will be able to determine the charge of the primary ions corresponding to each primary mass peak selected in the MS spectrum as precursor with the identification techniques normally employed in mass spectrometry.

Figure 3:
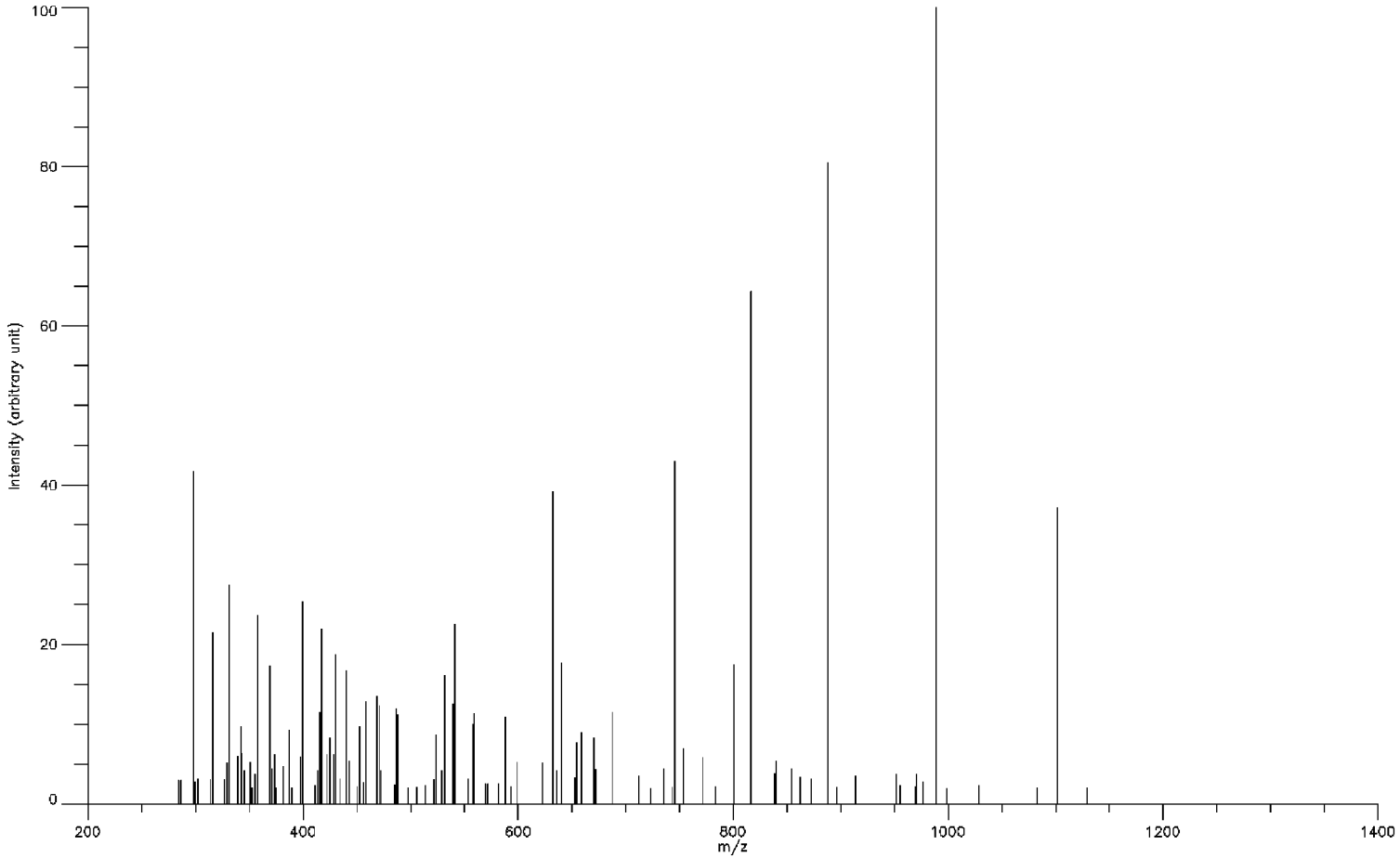
FIG. 3 shows the simplified multiplexed MS-MS spectrum produced by the dissociation of two precursors selected from the MS spectrum corresponding to FIG. 2, where the mass-to-charge ratio m/z values in Dalton (Da) of each MS-MS peak are on the abscissa axis and the corresponding maximum intensity values on the ordinate axis.

FIG. 3 shows an example of a simplified multiplexed MS-MS spectrum obtained conformingly to steps (b) and (c). The corresponding list of MS-MS mass-to-charge ratio (m/z) values and the corresponding maximum intensity values is shown in table 2. Conformingly to steps (b) and (c), the simplified MS-MS spectrum is obtained from a multiplexed MS-MS spectrum produced by the dissociation of the primary ions of two MS peaks selected simultaneously in the MS spectrum of FIG. 2. The corresponding mass-to-charge ratio (m/z) and maximum intensity values of the two selected MS peaks are written in bold in table 1.

According to the presentation graph conventionally used (though in no way limiting) by the person skilled in the art of mass spectrometry, the primary MS and the multiplexed MS-MS mass spectrum is generally shown, as in the examples of FIGS. 2 and 3, with two perpendicular axes, with the mass-to-charge ratio m/z values on the abscissa axis, and the corresponding intensity values on the ordinate axis.

In step (d) two individual MS-MS spectra are produced without using fragment filtering techniques by using the mass-to-charge ratio (m/z) and the corresponding charge values of each one of the two selected precursor listed in bold in table 1, and the simplified multiplexed MS-MS spectrum of table 2.

In step (e), the two individual MS-MS spectra and their corresponding precursor mass-to-charge ratio (m/z) and charge values, produced in step (d) have been submitted to real and corresponding decoy database searches by using Mascot without score identification threshold.

20 ppm MS accuracy and 0.05 Da MS-MS accuracy were used as parameters for the Mascot searches.

The mascot positive identification results of the real database search are shown in the second column of table 3a. The peptide precursors with mass-to-charge ratio m/z value of 652.3905 Da and 650.3741 Da obtained score identification of 63 and 15.

The Mascot positive identification results of decoy database searches are shown in the second column of table 3b, with an identification score of 4 and 3 for the peptide precursor with mass-to-charge ratio m/z value of 652.3905 Da, and 650.3741 Da.

All the possible theoretical fragment ion mass-to-charge ratio (m/z) values corresponding to the Mascot identifications of real database searches of step (e) of the two selected peptide precursors of the example of FIGS. 2 and 3, are shown in tables 4a and 4b. The amino acid sequences of the two corresponding identified peptides are shown in the first column of tables 4a and 4b.

All the possible theoretical ion fragment mass-to-charge ratio (m/z) values corresponding to the Mascot identification using decoy database searches of step (e) of the two selected peptide precursors of the example of FIGS. 2 and 3, are shown in tables 5a and 5b. The amino acid sequences of the two corresponding false identified peptides are shown in the first column of tables 5a and 5b.

The types of fragments listed in tables 4a, 4b, 5a and 5b are known to the person skilled in the art. These fragments comprises (b, y) fragments and the same fragments with neutral losses (H2O, NH3, CO) during the dissociation of the precursor ions.

The theoretical MS-MS mass-to-charge ratio (m/z) values corresponding to the identified experimental MS-MS mass-to-charge ratio (m/z) values for each one of the selected precursor of the real database searches of step (e) are listed in bold in tables 4a and 4b.

The theoretical MS-MS mass-to-charge ratio (m/z) values corresponding to the identified experimental MS-MS m/z values for each one of the selected precursor of the decoy database searches of step (e) are listed in bold in tables 5a and 5b.

In step (f), the two real individual MS-MS spectra of the two selected precursors corresponding to the results of the real data search of the step (e) are produced and are listed in the tables 6a and 6b.

The two real individual MS-MS spectra of tables 6a and 6b produced in step (f) are composed of the MS-MS mass-to-charge ratio (m/z) values and the corresponding maximum intensity values of ion fragments identified by the comparison within 20 ppm accuracy between the experimental MS-MS mass-to-charge ratio (m/z) values of the simplified MS-MS spectrum of table 2 and the theoretical mass-to-charge ratio m/z values of tables 4a and 4b.

In step (f), the two decoy individual MS-MS spectra of the two selected precursors corresponding to the results of the decoy data search of the step (e) are produced, and are listed in tables 7a and 7b.

The two decoy individual MS-MS spectra of tables 7a and 7b produced in step (f) are composed of the MS-MS mass-to-charge ratio (m/z) values and the corresponding maximum intensity values of ion fragments identified by the comparison within 20 ppm accuracy between the experimental MS-MS mass-to-charge ratio (m/z) values of the simplified MS-MS spectrum of table 2 and the theoretical mass-to-charge ratio m/z values of tables 5a and 5b. In step (g), the two real individual MS-MS spectra of tables 6a and 6b with the corresponding mass-to-charge ratio (m/z) values and charge values of the two selected peptide precursors have been submitted to real database searches by using Mascot with score identification threshold conditions.

The corresponding mascot positive identification results are shown in the third column of table 3a. The selected peptide precursor with mass-to-charge ratio (m/z) value of 652.3905 Da obtained an identification score of 107, and the selected peptide precursor with mass-to-charge ratio (m/z) value of 650.3741 Da obtained an identification score of 77.

In step (g), the two decoy individual MS-MS spectra of tables 7a and 7b with the corresponding mass-to-charge ratio (m/z) values and charge values of the two selected precursors have been submitted to decoy database searches by using Mascot with the same score identification threshold condition as used in the real database searches.

The corresponding Mascot false positive identification results are shown in the third column of table 3b. The selected peptide precursor with m/z value of 652.3905 Da obtained a false identification score of 51, and the selected peptide precursor with m/z value of 650.3741 Da obtained a false identification score of 31.

The identification scores of the real database searches of the third column of the example of table 3a are both significantly higher than the score identification threshold value of the Mascot analysis of all the LC-MS-MS data which is equal to 44, and corresponding to 0.5% FDR peptide value.

The two examples of peptides of table 3a (and their parent proteins) are positively identified in steps (h) and (i) of the method of the invention, by using the real database search results.

The higher identification score (which is 51) of the decoy database searches of the third column of the example of table 3b, corresponding to the selected precursor with mass-to-charge ratio (m/z) value equal to 652.3905 Da, is above the score identification threshold value of the Mascot analysis obtained with all the LC-MS-MS data, which equals to 44.

This positive identification of the decoy database search of step (g) will be used as false positive identification to estimate the number of false positive identifications of the real database search of step (g).

The lower identification score (which is 31) of the decoy database searches of the third column of the example of table 3b, corresponding to the selected precursor with mass-to-charge ratio (m/z) value equal to 650.3741 Da, is below the score identification threshold value of the Mascot analysis obtained with all the LC-MS-MS data, which equals to 44.

This negative identification resulting from the decoy database searches will not be used as false positive identification to statistically estimate the number of false positive identifications in the real database search.

The identification score threshold value of 44 used in the example of tables 3a and 3b, corresponding to an FDR value of 0.5%, has been obtained from the full LC-MS-MS data analysis by using the method of the invention as described further.

The Mascot results of standard database searches obtained without using the method of the invention, i.e. when only the selected precursor with higher intensity of the multiplexed spectrum is used in the analysis, will give only one positive precursor identification (with the mass-to-charge ratio m/z value of 652.3905 Da) above the threshold score value of 25 corresponding to a FDR value of 0.5% by using all the LC-MS-MS data in the standard analysis. The results of the third column of the table 3a corresponding to the final result of the method of the invention shows that the method of the invention allows the identification of the two selected peptide precursors with the identification score threshold value of 44 corresponding to the same FDR value of 0.5%.

In standard analysis without using the method of the invention, only the most intense precursor is considered for each produced MS-MS spectrum. The Mascot results of the analysis of the complete LC-MS-MS acquisition of *Escherichia Coli* sample described above, without using the method of the invention, provide 3896 identified peptides and 674 corresponding identified proteins. These results were obtained with a score threshold value of 25 corresponding to a FDR value of about 0.5% for peptide identifications, used for the standard Mascot real and decoy database searches.

Steps (a) to (d) of the method of the invention described above for one example of multiplexed MS-MS spectrum were applied to all the multiplexed MS-MS spectra of the *Escherichia Coli* LC-MS-MS acquisition.

The total number of experimental multiplexed MS-MS spectra produced in the LC-MS-MS acquisition was 8690. The number of MS-MS spectra produced in the step (d) by using the steps (a) to (d) of the method of the invention was 33325, corresponding to an increase of the MS-MS throughput by a factor of about 3.8 by using the method of the invention.

The positive identification Mascot results obtained by using steps (e) to (i) of the method of the invention with real database searches were 6055 identified peptides and 828 corresponding identified proteins. These results were obtained with a score threshold value of 44 corresponding to an FDR value of about 0.5% for peptide identifications, used for the Mascot real and decoy database searches.

The use of the method of the invention to analyze the same *Escherichia Coli* LC-MS-MS data produced with a Q-q-TOF mass spectrometer increases the number of identified peptides by 55% and the number of identified proteins by 23% compared with standard analysis by using the same Mascot parameters for the database searches and with the same FDR value of about 0.5%.

TABLE 1 example of simplified primary MS spectrum

| m/z (Da)<br>z | Relative<br>Intensity % |
|---|---|
| 299.2919<br>1+ | 0.73 |
| 400.5380<br>3+ | 2.27 |
| 405.8616<br>3+ | 4.44 |

TABLE 1-continued example of simplified primary MS spectrum

| m/z (Da) z | Relative Intensity % |
|---|---|
| 427.6905 4+ | 1.15 |
| 435.2628 3+ | 6.46 |
| 455.2559 3+ | 0.62 |
| 473.8817 3+ | 0.20 |
| 475.5678 3+ | 0.56 |
| 503.7856 2+ | 5.34 |
| 513.6208 3+ | 0.42 |
| 518.2447 3+ | 0.64 |
| 521.9367 3+ | 0.94 |
| 533.2542 2+ | 1.7 |
| 543.6158 3+ | 1.39 |
| 556.2683 3+ | 0.47 |
| 557.3057 3+ | 1.62 |
| 560.8030 1+ | 1.08 |
| 563.9263 3+ | 0.63 |
| 569.9183 3+ | 3.41 |
| 570.8379 2+ | 2.80 |
| 574.9426 3+ | 1.64 |
| 577.6211 3+ | 2.02 |
| 581.3309 2+ | 100 |
| 582.9805 3+ | 4.64 |
| 599.3135 2+ | 1.41 |
| 602.6405 3+ | 0.68 |
| 607.7870 1+ | 2.60 |
| 608.2888 2+ | 3.44 |
| 608.2891 4+ | 6.14 |
| 627.3258 2+ | 0.89 |
| 631.3205 3+ | 2.72 |
| 639.3080 3+ | 9.01 |
| 641.2687 3+ | 4.03 |
| 643.6650 3+ | 4.52 |
| 645.0170 3+ | 1.21 |
| 647.3872 2+ | 1.34 |
| **650.3741 2+** | **4.81** |
| **652.3905 2+** | **54.83** |
| 655.6516 3+ | 1.82 |
| 661.3253 4+ | 0.29 |

TABLE 1-continued example of simplified primary MS spectrum

| m/z (Da) z | Relative Intensity % |
|---|---|
| 662.9964 3+ | 1.86 |
| 672.3470 3+ | 5.10 |
| 682.3802 2+ | 4.63 |
| 685.5674 4+ | 2.06 |
| 696.3444 2+ | 4.36 |
| 696.5945 2+ | 2.89 |
| 696.8408 4+ | 2.66 |
| 698.3650 3+ | 3.43 |
| 704.0228 3+ | 3.50 |
| 705.0354 3+ | 5.35 |
| 710.0708 4+ | 2.38 |
| 710.3189 2+ | 3.75 |
| 712.8480 2+ | 5.04 |
| 718.6456 4+ | 8.59 |
| 729.6029 4+ | 1.19 |
| 740.4064 2+ | 5.14 |
| 747.3628 5+ | 6.72 |
| 750.9045 2+ | 2.68 |
| 764.4055 2+ | 9.86 |
| 767.7201 3+ | 4.68 |
| 769.7276 2+ | 1.05 |
| 776.0336 3+ | 4.9 |
| 776.3618 2+ | 3.2 |
| 782.4015 2+ | 2.13 |
| 810.7164 3+ | 3.21 |
| 814.9201 2+ | 1.98 |
| 823.3850 3+ | 3.30 |
| 827.9133 2+ | 30.03 |
| 833.8989 2+ | 2.87 |
| 835.3838 3+ | 5.97 |
| 835.4549 2+ | 6.83 |
| 845.3859 2+ | 1.73 |
| 847.4399 2+ | 1.70 |
| 854.3738 2+ | 0.98 |
| 865.9280 | 3.05 |
| 872.4336 2+ | 2.25 |
| 873.9672 2+ | 0.65 |
| 881.0969 3+ | 1.86 |

TABLE 1-continued example of simplified primary MS spectrum

| m/z (Da) z | Relative Intensity % |
|---|---|
| 883.1690 4+ | 2.93 |
| 903.4571 2+ | 1.54 |
| 913.7541 3+ | 0.56 |
| 927.7898 3+ | 1.17 |
| 928.7853 3+ | 7.48 |
| 933.9517 4+ | 1.95 |
| 946.4787 2+ | 1.33 |
| 946.7597 3+ | 0.80 |
| 947.9730 2+ | 1.44 |
| 957.8584 3+ | 1.39 |
| 958.9600 2+ | 0.64 |
| 961.3995 2+ | 4.97 |
| 965.7978 3+ | 4.34 |
| 972.4682 3+ | 0.94 |
| 982.9737 2+ | 3.45 |
| 1008.0169 2+ | 1.47 |
| 1047.0438 2+ | 0.29 |
| 1151.5782 2+ | 0.21 |
| 1177.2229 3+ | 2.00 |
| 1221.9809 1+ | 9.04 |
| 1392.6743 2+ | 0.34 |

TABLE 2

Example of simplified multiplexed MS-MS spectrum

| m/z (Da) | Relative Intensity % |
|---|---|
| 284.1593 | 2.94 |
| 286.1735 | 2.93 |
| 298.1740 | 41.75 |
| 299.2116 | 2.67 |
| 302.1676 | 3.12 |
| 314.2963 | 2.95 |
| 316.1838 | 21.41 |
| 327.1648 | 3.04 |
| 329.2115 | 2.02 |
| 329.2146 | 5.01 |
| 330.1631 | 4.89 |
| 331.2315 | 27.38 |
| 339.1646 | 4.43 |
| 339.2001 | 5.89 |
| 342.1990 | 9.68 |
| 343.1598 | 6.25 |
| 345.1733 | 4.22 |
| 351.2008 | 5.14 |
| 352.1571 | 1.95 |
| 355.1958 | 3.68 |
| 357.2106 | 23.58 |
| 369.2106 | 17.35 |
| 371.2232 | 4.32 |
| 373.2068 | 6.10 |

TABLE 2-continued

Example of simplified multiplexed MS-MS spectrum

| m/z (Da) | Relative Intensity % |
|---|---|
| 374.2378 | 2.78 |
| 375.1846 | 1.87 |
| 381.2117 | 4.62 |
| 387.1864 | 9.13 |
| 387.2189 | 5.14 |
| 389.2358 | 1.90 |
| 397.2402 | 5.83 |
| 399.2226 | 25.34 |
| 410.1987 | 2.00 |
| 411.2593 | 2.17 |
| 413.2332 | 4.09 |
| 415.2520 | 11.44 |
| 417.2325 | 21.94 |
| 422.2355 | 6.14 |
| 425.2321 | 8.17 |
| 428.2120 | 6.15 |
| 430.2998 | 18.71 |
| 434.2383 | 3.08 |
| 440.2499 | 16.74 |
| 443.2460 | 5.32 |
| 450.2657 | 2.15 |
| 452.2460 | 9.68 |
| 456.2431 | 2.62 |
| 456.2779 | 2.36 |
| 458.2591 | 12.81 |
| 468.2787 | 13.48 |
| 470.2598 | 12.33 |
| 472.2715 | 4.18 |
| 485.3223 | 2.29 |
| 486.2888 | 11.94 |
| 488.2650 | 11.14 |
| 497.2673 | 1.94 |
| 505.2732 | 1.98 |
| 513.3019 | 2.25 |
| 521.3057 | 3.02 |
| 523.2842 | 8.54 |
| 528.3314 | 4.21 |
| 531.3459 | 16.10 |
| 539.3141 | 12.50 |
| 541.2955 | 22.53 |
| 553.3339 | 3.07 |
| 557.3242 | 9.98 |
| 559.3050 | 11.31 |
| 569.3297 | 2.41 |
| 571.3453 | 2.36 |
| 581.3602 | 2.40 |
| 588.3317 | 10.86 |
| 592.8623 | 2.13 |
| 599.3738 | 5.11 |
| 622.3526 | 5.03 |
| 632.3928 | 39.19 |
| 636.3648 | 4.10 |
| 640.3635 | 17.55 |
| 652.3948 | 3.18 |
| 654.3769 | 7.60 |
| 658.3730 | 8.86 |
| 670.4085 | 8.20 |
| 672.3895 | 4.30 |
| 687.3981 | 11.42 |
| 712.4270 | 3.38 |
| 723.4366 | 1.85 |
| 735.4386 | 4.41 |
| 743.4699 | 2.02 |
| 745.4768 | 43.03 |
| 753.4436 | 6.88 |
| 771.4558 | 5.78 |
| 783.4648 | 2.16 |
| 800.4824 | 17.36 |
| 816.5125 | 64.33 |
| 838.5322 | 3.76 |
| 839.5387 | 5.32 |
| 854.5034 | 4.38 |
| 862.5050 | 3.27 |
| 872.4387 | 3.13 |
| 887.5500 | 80.49 |

TABLE 2-continued

| Example of simplified multiplexed MS-MS spectrum | |
|---|---|
| m/z (Da) | Relative Intensity % |
| 896.4220 | 2.06 |
| 913.5692 | 3.35 |
| 951.6138 | 3.72 |
| 955.5527 | 2.20 |
| 969.4891 | 2.16 |
| 970.5888 | 3.64 |
| 976.4577 | 2.68 |
| 988.5953 | 100 |
| 998.5806 | 1.86 |
| 1028.5927 | 2.17 |
| 1082.6094 | 1.91 |
| 1101.6792 | 37.09 |
| 1129.6378 | 1.97 |

TABLE 3a

| Real database search results | | |
|---|---|---|
| m/z values of peptide precursors | Mascot Identification scores of real database searches by using step (e) of the method of the invention | Mascot Identification scores of real database searches by using step (g) of the method of the invention |
| 650.3741 | 15 | 77 |
| 652.3905 | 63 | 103 |

TABLE 3b

| Decoy database search results | | |
|---|---|---|
| m/z values of peptide precursors | Mascot Identification scores of decoy database searches by using step (e) the method of the invention | Mascot Identification scores of decoy database searches by using step (g) of the method of the invention |
| 650.3741 | 3 | 31 |
| 652.3905 | 4 | 51 |

TABLE 4a

| m/z values of theoretical fragments for positive identification of precursor m/z = 652.3905 Da with real database searches (Da) | | | | | | |
|---|---|---|---|---|---|---|
| Amino Acid Sequence | b<br>y | $b^{++}$<br>$y^{++}$ | b*<br>y* | $b^{*++}$<br>$y^{*++}$ | $b^{0}$<br>$y^{0}$ | $b^{0++}$<br>$y^{0++}$ |
| T | 102.0550 | 51.5311 | | | 84.0444 | 42.5258 |
| | — | — | | | — | — |
| T | 203.1026 | 102.0550 | — | — | 185.0921 | 93.0497 |
| | 1202.7355 | 601.8714 | 1185.7089 | 593.3581 | 1184.7249 | **592.8661** |
| L | **316.1867** | 158.5970 | — | — | **298.1761** | 149.5917 |
| | **1101.6878** | 551.3475 | 1084.6612 | 542.8343 | 1083.6772 | 542.3423 |
| T | **417.2344** | 209.1208 | — | — | **399.2238** | 200.1155 |
| | **988.6037** | 494.8055 | 971.5772 | **486.2922** | **970.5932** | 485.8002 |
| A | **488.2715** | 244.6394 | — | — | **470.2609** | 235.6341 |
| | **887.5560** | 444.2817 | 870.5295 | 435.7684 | 869.5455 | 435.2764 |
| A | **559.3086** | 280.1579 | — | — | **541.2980** | 271.1527 |
| | **816.5189** | 408.7631 | 799.4924 | 400.2498 | 798.5084 | 399.7578 |
| I | **672.3927** | 336.7000 | — | — | **654.3821** | 327.6747 |
| | **745.4818** | 373.2445 | 728.4553 | 364.7313 | 727.4713 | 364.2393 |
| T | 773.4403 | **387.2238** | — | — | 755.4298 | 378.2185 |
| | **632.3978** | 316.7025 | 615.3712 | 308.1892 | 614.3872 | 307.6972 |
| T | 874.4880 | 437.7477 | — | — | 856.4775 | 428.7424 |
| | **531.3501** | 266.1787 | 514.3225 | 257.6654 | **513.3395** | 257.1734 |
| V | 973.5564 | 487.2819 | — | — | 955.5459 | 478.2766 |
| | **430.3024** | 215.6548 | **413.2758** | 207.1416 | — | — |
| L | 1086.6405 | 543.8239 | — | — | 1068.6299 | 534.8186 |
| | **331.2340** | 166.1206 | 314.2074 | 157.6074 | — | — |
| A | 1157.6776 | 579.3424 | — | — | 1139.6671 | 570.3372 |
| | 218.1499 | 109.5786 | 201.1234 | 101.0653 | — | — |
| K | — | — | — | — | | |
| | 147.1128 | 74.0600 | 130.0863 | 65.5468 | | |

TABLE 4b

| Amino Acid Sequence | b<br>y | $b^{++}$<br>$y^{++}$ | b*<br>y* | $b^{*++}$<br>$y^{*++}$ | $b^{0}$<br>$y^{0}$ | $b^{0++}$<br>$y^{0++}$ |
|---|---|---|---|---|---|---|
| | m/z values of theoretical fragments for positive identification of precursor m/z = 650.3741 with real database searches (Da) | | | | | |
| G | 58.0287 | 29.5180 | | | | |
| | — | — | | | | |
| I | 171.1128 | 86.0600 | — | — | — | — |
| | 1242.7304 | 621.8688 | 1225.7038 | 613.3556 | 1224.7198 | 612.8635 |
| T | 272.1605 | 136.5839 | — | — | 254.1499 | 127.5786 |
| | **1129.6463** | 565.3268 | 1112.6198 | 556.8135 | 1111.6458 | 556.3215 |
| D | **387.1874** | 194.0974 | — | — | **369.1769** | 185.0921 |
| | **1028.5986** | 514.8030 | 1011.5721 | 506.2897 | 1010.5881 | 505.7977 |
| I | 500.2715 | 250.6394 | — | — | 482.2609 | 241.6341 |
| | **913.5717** | 457.2895 | 896.5451 | 448.7762 | 895.5611 | 448.2842 |
| L | 613.3556 | 307.1814 | — | — | 595.3450 | **298.1761** |
| | **800.4876** | 400.7475 | **783.4611** | 392.2342 | 782.4771 | 391.7422 |
| V | **712.4240** | 356.7156 | — | — | 694.4134 | 347.7103 |
| | **687.4036** | 344.2054 | **670.3770** | 335.6921 | 669.3930 | 335.2001 |
| V | 811.4924 | 406.2498 | — | — | 793.4818 | **397.2445** |
| | **588.3352** | 294.6712 | **571.3086** | **286.1579** | 570.3246 | 285.6659 |
| D | 926.5193 | 463.7633 | — | — | 908.5088 | 454.7580 |
| | 489.2667 | 245.1370 | **472.2402** | 236.6237 | 471.2562 | 236.1317 |
| N | 1040.5623 | 520.7848 | 1023.5357 | 512.2715 | 1022.5517 | 511.7795 |
| | 374.2398 | 187.6235 | **357.2132** | 179.1103 | — | — |
| L | 1153.6463 | 577.3268 | 1136.6198 | 568.8135 | 1135.6358 | 568.3215 |
| | 260.1969 | 130.6021 | 243.1703 | 122.0888 | — | — |
| K | — | — | — | — | | |
| | 147.1128 | 74.0600 | 130.0863 | 65.5468 | | |

TABLE 5a

| Amino Acid Sequence | b<br>y | $b^{++}$<br>$y^{++}$ | b*<br>y* | $b^{*++}$<br>$y^{*++}$ | $b^{0}$<br>$y^{0}$ | $b^{0++}$<br>$y^{0++}$ |
|---|---|---|---|---|---|---|
| | m/z values of theoretical fragments for positive identification of precursor m/z = 652.3905 with decoy database searches (Da) | | | | | |
| R | 157.1084 | 79.0578 | 140.0818 | 70.5446 | | |
| | — | — | — | — | | |
| I | 270.1925 | 135.5999 | 253.1659 | 127.0866 | — | — |
| | 1147.6834 | 574.3453 | 1130.6568 | 565.8320 | **1129.6728** | 565.3400 |
| S | **357.2245** | 179.1159 | 340.1979 | 170.6026 | 339.2139 | 170.1106 |
| | 1034.5993 | 517.8033 | 1017.5728 | 509.2900 | 1016.5887 | 508.7980 |
| F | 504.2929 | 252.6501 | 487.2663 | 244.1368 | 486.2823 | 243.6448 |
| | 947.5673 | 474.2873 | 930.5407 | 465.7740 | 929.5567 | 465.2820 |
| K | **632.3879** | 316.6976 | 615.3613 | 308.1843 | 614.3773 | 307.6923 |
| | **800.4989** | 400.7531 | 783.4723 | 392.2398 | 782.4883 | 391.7478 |
| L | **745.4719** | 373.2396 | 728.4454 | 364.7263 | 727.4614 | 364.2343 |
| | 672.4039 | 336.7056 | 655.3774 | 328.1923 | 654.3933 | 327.7003 |
| S | 832.5039 | 416.7556 | 815.4774 | 408.2423 | 814.4934 | 407.7503 |
| | **559.3198** | 280.1636 | 542.2933 | 271.6503 | **541.3093** | 271.1583 |
| P | 929.5567 | 465.2820 | 912.5302 | 456.7687 | 911.5461 | 456.2767 |
| | 472.2878 | 236.6475 | 455.2613 | 228.1343 | 454.2772 | 227.6423 |
| S | 1016.5887 | 508.7980 | 999.5622 | 500.2847 | 998.5782 | 499.7927 |
| | 375.2350 | 188.1212 | 358.2085 | 179.6079 | **357.2245** | 179.1159 |
| L | **1129.6728** | 565.3400 | 1112.6463 | 556.8268 | 1111.6622 | 556.3348 |
| | 288.2030 | 144.6051 | 271.1765 | 136.0919 | — | — |
| R | — | — | — | — | | |
| | 175.1190 | 88.0631 | 158.0924 | 79.5498 | | |

TABLE 5b

| Amino Acid Sequence | b<br>y | $b^{++}$<br>$y^{++}$ | b*<br>y* | $b^{*++}$<br>$y^{*++}$ | $b^{0}$<br>$y^{0}$ | $b^{0++}$<br>$y^{0++}$ |
|---|---|---|---|---|---|---|
| | m/z values of theoretical fragments for positive identification of precursor m/z = 650.3741 with decoy database searches (Da) | | | | | |
| A | 72.0444 | 36.5258 | | | | |
| | — | — | | | | |
| L | 185.1285 | 93.0679 | — | — | — | — |
| | 1228.7008 | 614.8540 | 1211.6743 | 606.3408 | 1210.6902 | 605.8488 |
| I | **298.2125** | 149.6099 | — | — | — | — |

TABLE 5b-continued

| Amino Acid Sequence | b<br>y | $b^{++}$<br>$y^{++}$ | b*<br>y* | $b^{*++}$<br>$y^{*++}$ | $b^{0}$<br>$y^{0}$ | $b^{0++}$<br>$y^{0++}$ |
|---|---|---|---|---|---|---|
| | 1115.6167 | 558.3120 | 1098.5902 | 549.7987 | 1097.6002 | 549.3067 |
| D | 413.2395 | 207.1234 | — | — | 395.2289 | 198.1181 |
| | 1002.5327 | 501.7700 | 985.5061 | 493.2567 | 984.5221 | 492.7647 |
| A | 484.2766 | 242.6419 | — | — | 466.2660 | 233.6366 |
| | **887.5057** | 444.2565 | 870.4792 | 435.7432 | 869.4952 | 435.2512 |
| L | 597.3606 | 299.1840 | — | — | 579.3501 | 290.1787 |
| | **816.4686** | 408.7380 | 799.4421 | 400.2247 | 798.4581 | 399.7327 |
| S | 684.3927 | 342.7000 | — | — | 666.3821 | 333.6947 |
| | 703.3846 | 352.1959 | 686.3580 | 343.6826 | 685.3740 | 343.1906 |
| R | 840.4938 | 420.7505 | 823.4672 | 412.2373 | 822.4832 | 411.7452 |
| | 616.3525 | 308.6799 | 599.4260 | 300.1666 | 598.3420 | 299.6746 |
| T | 941.5415 | 471.2744 | 924.5149 | 462.7611 | 923.5309 | 462.2691 |
| | 460.2514 | 230.6293 | 443.2249 | 222.1161 | 442.2409 | 221.6241 |
| S | **1028.5735** | 514.7904 | 1011.5469 | 506.2771 | 1010.5629 | 505.7851 |
| | 359.2037 | 180.1055 | 342.1772 | 171.5922 | 341.1932 | 171.1002 |
| P | 1125.6262 | 563.3168 | 1108.5997 | 554.8035 | 1107.6157 | 554.3115 |
| | 272.1717 | 136.5895 | 255.1452 | 128.0762 | — | — |
| R | — | — | — | — | | |
| | 175.1190 | 88.0631 | 158.0924 | 79.5498 | | |

TABLE 6a corrected individual MS-MS spectrum of step (f) of the method of the invention for real database search
Precursor m/z = 652.3095 Da

| m/z (Da) | Relative Intensity % |
|---|---|
| 298.1740 | 41.75 |
| 316.1838 | 21.41 |
| 331.2315 | 27.38 |
| 387.2189 | 5.14 |
| 399.2226 | 25.34 |
| 417.2325 | 21.94 |
| 430.2998 | 18.71 |
| 470.2598 | 12.33 |
| 486.2888 | 11.94 |
| 488.2650 | 11.14 |
| 531.3459 | 16.10 |
| 541.2955 | 22.53 |
| 559.3050 | 11.31 |
| 632.3928 | 39.19 |
| 654.3769 | 7.60 |
| 672.3895 | 4.30 |
| 745.4768 | 43.03 |
| 816.5125 | 64.33 |
| 887.5500 | 80.49 |
| 970.5888 | 3.64 |
| 988.5953 | 100 |
| 1101.6792 | 37.09 |

TABLE 6b corrected individual MS-MS spectrum of step (f) of the method of the invention for real database search
Precursor m/z = 650.3741 Da

| m/z (Da) | Relative Intensity % |
|---|---|
| 298.1740 | 41.75 |
| 357.2106 | 23.58 |
| 374.2378 | 2.78 |
| 387.1864 | 9.13 |
| 397.2402 | 5.83 |
| 588.3317 | 10.86 |
| 687.3981 | 11.42 |
| 712.4270 | 3.38 |

TABLE 6b-continued corrected individual MS-MS spectrum of step (f) of the method of the invention for real database search
Precursor m/z = 650.3741 Da

| m/z (Da) | Relative Intensity % |
|---|---|
| 783.4648 | 2.16 |
| 800.4824 | 17.36 |
| 913.5692 | 3.35 |
| 1028.5927 | 2.17 |
| 1129.6378 | 1.97 |

TABLE 7a corrected individual MS-MS spectrum of step (f) of the method of the invention for decoy database search
Precursor m/z = 652.3095 Da

| m/z (Da) | Relative Intensity % |
|---|---|
| 486.2888 | 11.94 |
| 745.4768 | 43.03 |
| 783.4648 | 2.16 |
| 998.5806 | 1.86 |

TABLE 7b corrected individual MS-MS spectrum of step (f) of the method of the invention for decoy database search
Precursor m/z = 650.3741 Da

| m/z (Da) | Relative Intensity % |
|---|---|
| 413.2332 | 4.09 |
| 1028.5927 | 2.17 |

Second Example

A non-limiting second example of implementation of the method of the invention will now be described with reference to FIG. 4.

A protein sample of Human cell was prepared, as known by the skilled person in the art, for LC-MS-MS analysis by using an LC-ESI-IT(LTQ)-FT-MS (Orbitrap) mass spectrometer.

1 μg of the protein sample was digested using trypsin to generate a mixture of peptides before the injection in the LC capillary column 1. Effluent from the LC column 1 was electrosprayed by the ESI ion source 2 into the used IT-FT-MS mass spectrometer 5 to produce the MS and the multiplexed MS-MS spectra of the peptide mixture.

During the elution time, at each LC peak, MS spectra have been produced using the FT-MS mass spectrometer, following by the multiplexed MS-MS spectra production corresponding to the second method of multiplexed MS-MS production described above.

Each MS spectrum is produced in the FT-MS mass spectrometer. After each selection of the precursors with the IT 3, the selected primary ions are injected in the collision cell (HCD) 4 in order to be dissociated by CID, before to be injected in the FT-MS mass spectrometer 5 to produce each multiplexed MS-MS spectrum.

The width of the mass selection windows used for the precursor selection in the MS spectrum was about 6 Da, instead of the one of 3 Da normally used in standard LC-MS-MS with the used IT-FT-MS mass spectrometer.

The MS resolution used to produce the MS spectrum was 30000, and the MS-MS resolution was 7500. The corresponding MS and MS-MS accuracies used in the analysis were 4 ppm and 10 ppm.

The Mascot results of the analysis of the complete LC-MS-MS acquisition of Human cell sample described above, without using the method of the invention, provide 2838 identified peptides and 761 corresponding identified proteins. These results were obtained with a score threshold value of 37 corresponding to a FDR value of about 0.85% for peptide identifications, used for the standard Mascot real and decoy database searches.

Steps (a) to (d) of the method of the invention described above were applied to all the multiplexed MS-MS spectra of the LC-MS-MS acquisition.

The total number of experimental multiplexed MS-MS spectra produced in the LC-MS-MS acquisition was 15242. The number of MS-MS spectra produced in the step (d) by using the steps (a) to (d) of the method of the invention was 49605, corresponding to an increase of the MS-MS throughput by a factor of about 3.25 by using the method of the invention.

The positive identification Mascot results obtained by using steps (e) to (i) of the method of the invention with real database searches provided 9742 identified peptides and 1318 corresponding identified proteins. These results were obtained with a score threshold value of 66 corresponding to a FDR value of about 0.86% for peptide identifications, used for the Mascot real and decoy database searches.

4 ppm MS accuracy and 0.01 Da MS-MS accuracy were used as parameters for the Mascot searches.

The use of the method of the invention to analyze the same Human cell LC-MS-MS data produced with an LTQ-Orbitrap increases the number of identified peptides by 243% and the number of identified proteins by 73% compared with standard analysis by using the same Mascot parameters for the database searches and with the same FDR value of about 0.85%.

BIBLIOGRAPHICAL REFERENCES

[1] J. D. Pinston et al, Rev. Sci. Instrum., 57 (4), (1983), p. 583. C. G. Enke et al, U.S. Pat. No. 4,472,631 (1984).

[2] C. G. Enke, patent PCT/US 2004/008424.

[3] Alderdice et al, U.S. Pat. No. 5,206,508 (1993).

[4] R. N. Bateman, J. M. Brown, D. J. Kenny, US patent 2005/0098721 A1 (2005).

[5] R. W. Vachet and J. Wilson, U.S. Pat. No. 7,141,784 (2006).

[6] D. Scigocki, patent PCT/EP2008/056428.

[7] R. N. Bateman et al, EP 1 385 194 A2 (2004).

[8] C. Masselon et al, Proteomics, 3, (2003), p. 1279.

[9] D. Scigocki, patent application PCT/EP2007/05059.

[10] D. Scigocki, patent application PCT/EP2008/068271.

The invention claimed is:

1. A method for multiplexed tandem mass spectrometry of a sample to be analysed containing at least two precursors, wherein at least two simplified multiplexed MS-MS spectra are obtained each from at least two selected precursors of the sample, the method comprising:

(d) for each selected precursor generating an individual MS-MS spectrum from the simplified multiplexed MS-MS spectrum by selecting maximum intensity values and corresponding mass-to-charge ratio m/z values of fragment ions of the simplified multiplexed MS-MS spectrum, wherein the fragment ions are potential fragment ions obtained from the precursor;

(e) submitting each individual MS-MS spectrum of step (d) to a real and a decoy database search using a scoring process without a score threshold condition or a low score threshold condition for identifying candidate precursors and their fragment ions;

(f) producing real individual MS-MS spectra by selecting fragment ions in the simplified multiplexed MS-MS spectrum which correspond to fragment ions from identified candidate precursors resulting from the real database search of step (e), one real individual MS-MS spectrum being produced for one identified candidate precursor; and producing decoy individual MS-MS spectra by selecting fragment ions in the simplified multiplexed MS-MS spectrum which correspond to fragment ions from identified candidate precursors resulting from the decoy database search of step (e), one decoy individual MS-MS spectrum being produced for one identified candidate precursor; and (g) submitting the real and decoy individual MS-MS spectra to a further scoring process with a score threshold condition for determining a score for each real and decoy individual MS-MS spectra;

wherein the simplified multiplexed MS-MS spectrum is obtained using a mass spectrometer, and wherein producing a real, respectively decoy, individual MS-MS spectrum of step (f) comprises:

computing from a candidate precursor identified in step (e) using the real, respectively decoy, database search a list of mass-to-charge ratio m/z values corresponding to theoretical fragment ions of the candidate precursor;

selecting all fragment ions of the simplified multiplexed MS-MS spectrum, of which the mass-to-charge ratio m/z values match with a mass-to-charge ratio m/z value of the list, within MS-MS accuracy of the mass spectrometer.

2. The method of claim 1, wherein step (g) comprises submitting the real, respectively decoy, individual MS-MS spectra to a real, respectively decoy, database search using scoring process with score threshold condition.

3. The method of claim 2, wherein the real, respectively decoy, databases used in step (e) and step (g) are identical.

4. The method of claim 2, wherein the real, respectively decoy databases used in step (e) and step (g) are different.

5. The method of claim 1, wherein the scoring processes used in step (e) and step (g) are identical processes, respectively without and with a threshold condition.

6. The method of claim 1, wherein the scoring processes used in step (e) and step (g) are different.

7. The method of claim 1, wherein determining a score for a real, respectively decoy, individual MS-MS spectrum in step (g) comprises dividing the number of fragment ions of the real, respectively decoy, individual MS-MS spectrum by the number of all theoretically possible fragment ions of the candidate precursor identified in step (e).

8. The method of claim 1, wherein, for each selected precursor, the individual MS-MS spectrum of step (d) comprises the simplified multiplexed MS-MS spectrum and mass or mass-to-charge ratio (m/z) value of the selected precursor.

9. The method of claim 1, further comprising, prior to step (d):

forming fragment ion pairs or multiplets from masses of the fragment ions of the simplified multiplexed MS-MS spectrum; when the sum of the masses of at least two fragment ions equals the mass of one given selected precursor, the at least two fragment ions form a fragment ion pair or multiplet and are assigned to the given selected precursor; and wherein in step (d), the individual MS-MS spectrum of the given selected precursor comprises the assigned fragment ion pairs and/or multiplets and the mass or mass-to-charge ratio (m/z) value of the given selected precursor.

10. A computer program designed to be implemented in a tandem mass spectrometry system, including a set of instructions adapted to control said mass spectrometry system so that it performs the method of claim 1 when the computer program is run in the tandem mass spectrometry system.

11. A method for multiplexed tandem mass spectrometry of a sample to be analysed containing at least two precursors, wherein at least two simplified multiplexed MS-MS spectra are obtained each from at least two selected precursors of the sample, the method comprising:

(d) for each selected precursor generating an individual MS-MS spectrum from the simplified multiplexed MS-MS spectrum by selecting maximum intensity values and corresponding mass-to-charge ratio m/z values of fragment ions of the simplified multiplexed MS-MS spectrum, wherein the fragment ions are potential fragment ions obtained from the precursor;

(e) submitting each individual MS-MS spectrum of step (d) to a real and a decoy database search using a scoring process without a score threshold condition or a low score threshold condition for identifying candidate precursors and their fragment ions;

(f) producing real individual MS-MS spectra by selecting fragments ions in the simplified multiplexed MS-MS spectrum which correspond to fragments ions from identified candidate precursors resulting from the real database search of step (e), one real individual MS-MS spectrum being produced for one identified candidate precursor; and producing decoy individual MS-MS spectra by selecting fragments ions in the simplified multiplexed MS-MS spectrum which correspond to fragments ions from identified candidate precursors resulting from the decoy database search of step (e), one decoy individual MS-MS spectrum being produced for one identified candidate precursor; and (g) submitting the real and decoy individual MS-MS spectra to a further scoring process with a score threshold condition for determining a score for each real and decoy individual MS-MS spectra, wherein producing a real, respectively decoy, individual MS-MS spectrum of step (f) comprises:

selecting fragment ions in the simplified multiplexed MS-MS spectrum, which match the fragment ions of the candidate precursor, the fragment ions of the candidate precursor being identified in step (e) using the real, respectively decoy, database search.

12. The method of claim 11, wherein step (g) comprises submitting the real, respectively decoy, individual MS-MS spectra to a real, respectively decoy, database search using scoring process with score threshold condition.

13. The method of claim 12, wherein the real, respectively decoy, databases used in step (e) and step (g) are identical.

14. The method of claim 12, wherein the real, respectively decoy databases used in step (e) and step (g) are different.

15. The method of claim 11, wherein the scoring processes used in step (e) and step (g) are identical processes, respectively without and with a threshold condition.

16. The method of claim 11, wherein the scoring processes used in step (e) and step (g) are different.

17. The method of claim 11, wherein determining a score for a real, respectively decoy, individual MS-MS spectrum in step (g) comprises dividing the number of fragment ions of the real, respectively decoy, individual MS-MS spectrum by the number of all theoretically possible fragment ions of the candidate precursor identified in step (e).

18. The method of claim 11, wherein, for each selected precursor, the individual MS-MS spectrum of step (d) comprises the simplified multiplexed MS-MS spectrum and mass or mass-to-charge ratio (m/z) value of the selected precursor.

19. The method of claim 11, further comprising, prior to step (d):

forming fragment ion pairs or multiplets from masses of the fragment ions of the simplified multiplexed MS-MS spectrum; when the sum of the masses of at least two fragment ions equals the mass of one given selected precursor, the at least two fragment ions form a fragment ion pair or multiplet and are assigned to the given selected precursor; and wherein in step (d), the individual MS-MS spectrum of the given selected precursor comprises the assigned fragment ion pairs and/or multiplets and the mass or mass-to-charge ratio (m/z) value of the given selected precursor.

20. A computer program designed to be implemented in a tandem mass spectrometry system, including a set of instructions adapted to control said mass spectrometry system so that it performs the method of claim 11 when the computer program is run in the tandem mass spectrometry system.

* * * * *